US006297810B1

(12) United States Patent
Anderson

(10) Patent No.: US 6,297,810 B1
(45) Date of Patent: Oct. 2, 2001

(54) PROGRAMMABLE SWITCH ARRAY WITH TACTICAL FEEL

(75) Inventor: Roger D. Anderson, Marengo, IA (US)

(73) Assignee: Rockwell Collins, Cedar Rapids, IA (US)

( * ) Notice: Subject to any disclaimer, the term of this patent is extended or adjusted under 35 U.S.C. 154(b) by 0 days.

(21) Appl. No.: 09/164,059

(22) Filed: Sep. 30, 1998

(51) Int. Cl.[7] ..... G09G 5/00
(52) U.S. Cl. ..... 345/173; 345/174; 345/104
(58) Field of Search ..... 345/173, 174, 345/104; 178/18

(56) References Cited

U.S. PATENT DOCUMENTS 4,771,277 * 9/1988 Barbee et al. ..... 345/173
4,822,957 * 4/1989 Talmage, Jr. et al. ..... 178/18
5,305,017 * 4/1994 Gerpheide ..... 345/174
5,596,343 * 1/1997 Snider ..... 345/173
5,815,141 * 9/1998 Phares ..... 345/173
6,030,267 * 9/1988 Browning ..... 445/25
6,031,336 * 2/2000 Rumbaugh et al. ..... 315/169.3

* cited by examiner

*Primary Examiner*—Richard Hjerpe
*Assistant Examiner*—Kimnhung Nguyen
(74) *Attorney, Agent, or Firm*—Nathan O. Jensen; Kyle Eppele

(57) ABSTRACT

Disclosed are a programmable switch array which provides tactical feel indication of activation to a user. The switch array includes a display device adapted to display switch information. A glass plate is positioned in front of the display device. Multiple switching mechanisms are positioned behind the glass plate. One or more pivot members are positioned behind the glass plate and disposed such that upon the user pushing upon a region of the glass plate, the glass plate pivots about the pivot member and actuates a corresponding one of the multiple switching mechanisms. The pivoting of the glass plate provides the user a tactical feel indication of the activation of the switch.

14 Claims, 3 Drawing Sheets

100
190
CONTROL CIRCUITRY
115
LCD DRIVE CIRCUITRY
110
BACKLIGHT
120
CONTROL CIRCUITRY
190
140
150
135
105
130
125
150
143

100
141
150
170
156
125
175
147
142
150
146
105
155
135
145
140
150
105
135
105
135
105
135
105
135
157
148
143
150
165
160
158
180

PROGRAMMABLE SWITCH ARRAY WITH TACTICAL FEEL

FIELD OF THE INVENTION

The present invention relates to programmable switch arrays for use in aircraft cockpits and other applications. More particularly, the present invention relates to a sunlight readable, color programmable switch array providing a tactical feel indicative of actuation or changes in switch states.

BACKGROUND OF THE INVENTION

In aircraft cockpits and other applications, large numbers of switches are used to control electronics and aircraft functions. It is desirable to utilize programmable switch arrays which can be easily adapted to display a variety of information related to the state of the switches, as well as the functions which these switches control. It is also preferable to have switches which are readable in high ambient light conditions (i.e., sunlight readable), and which can be easily viewed from large viewing angles.

In the prior art, liquid crystal displays (LCDs) having touch sensitive screens have been used to provide switching functions. However, these prior art LCD switch arrays lack a tactical feel. In other words, for a pilot or other user to be certain that the switch has been actuated or changed states, he or she must typically look at the display screen to verify a change in the displayed information. In many applications, it is very undesirable and unsafe for the user of the switch array to have to look at the display screen to make this determination.

SUMMARY OF THE INVENTION

Disclosed are a programmable switch array which provides tactical feel indication of activation to a user. The switch array includes a display device adapted to display switch information. A glass plate is positioned in front of the display device. Multiple switching mechanisms are positioned behind the glass plate. One or more pivot members are positioned behind the glass plate and disposed such that upon the user pushing upon a region of the glass plate, the glass plate pivots about the pivot member and actuates a corresponding one of the multiple switching mechanisms. The pivoting of the glass plate provides the user a tactical feel indication of the activation of the switch.

DETAILED DESCRIPTION OF THE PREFERRED EMBODIMENTS

Figure 2:
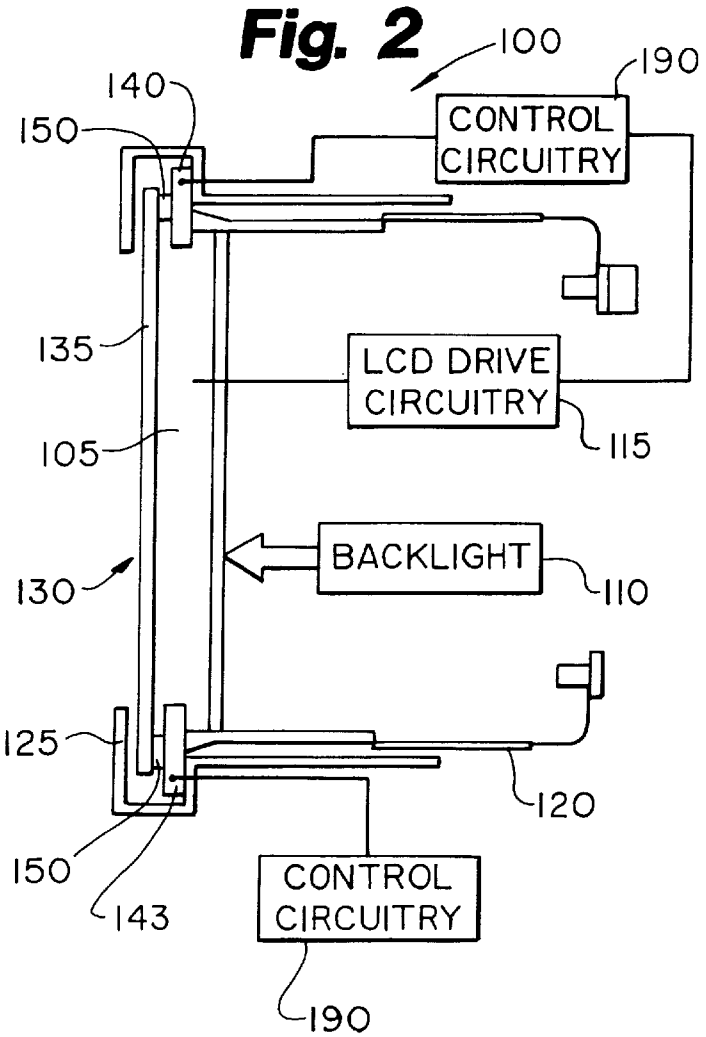
FIGS. 1 and 2 are front and side diagrammatic views, respectively, of a programmable switch array in accordance with embodiments of the present invention.
Figure 1:
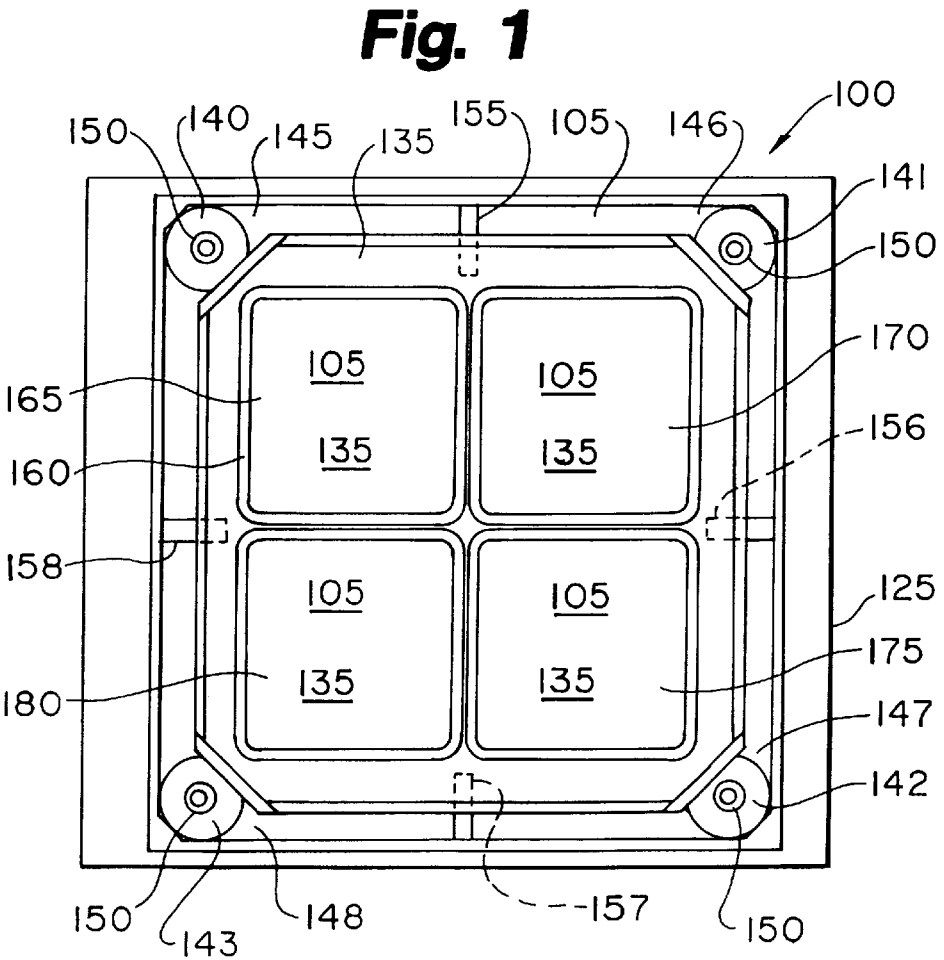

FIGS. 1 and 2 are front and side diagrammatic views, respectively, of programmable switch array 100 in accordance with embodiments of the present invention. Switch array 100 includes LCD assembly 105, backlight 110, LCD drive circuitry 115, chassis or housing 120, switch/LCD bezel 125, and front plate dome switch assembly 130.

LCD assembly 105 preferably includes a compensated color LCD to provide a high degree of sunlight readability, high resolution and good performance at large viewing angles. LCD assembly 105 is typically mounted in or coupled to a chassis or housing 120. Backlight 110 and LCD drive circuitry 115 together cooperate with LCD assembly 105 to display information on LCD 105 in a known manner.

Front plate dome switch assembly 130 includes a sunlight reflectance minimizing coated (also referred to as an HEA coated) front plate glass 135, four dome switches 140, 141, 142 and 143 mounted at least partially behind corners 145, 146, 147 and 148, respectively, of front plate glass 135, spacers 150 positioned between front plate glass 135 and the dome switches, and four rocker pins or pivot members 155, 156, 157 and 158 connected to bezel 125 or elsewhere. Front plate glass 135 is preferably a square or rectangular shape, which can include angled portions at its corners. However, front plate glass 135 can be formed in a wide variety of shapes. Front plate glass 135 is positioned with its corners adjacent respective ones of dome switches 140, 141, 142 and 143. In the embodiment illustrated in FIGS. 1 and 2, spacers 150, which can be silicon spacers, can be included to separate front plate glass 135 from the dome 140. In FIG. 1, for ease of illustration, the corners of front plate glass 135 are removed and it appears that front plate glass is positioned directly over top of a portion of the respective dome switches, but not over spacers 150. In FIG. 2, front plate glass 150 is shown positioned with spacers 150 positioned between front plate glass 135 and dome switches 140. In different embodiments of the present invention, either of these configurations can be used.

Front plate glass 135 is positioned against, and is supported by, pivot members 155, 156, 157 and 158. By placing the pivot members substantially at the respective middles of each of the four sides of front plate glass 135, front plate glass 135 can be caused to pivot toward one of the four dome switches by applying a force on the glass near the corresponding corner.

Front panel 160 of bezel 125 forms four windows 165, 170, 175 and 180. Through these windows, a user of switch array 100 can touch front plate glass 135. Also, through these respective windows, the user of switch array 100 can see information displayed by LCD assembly 105 in relation to a status of, or a function controlled by, the corresponding dome switches.

With LCD assembly 105 segmented into a number of small windows in which text, graphics or other information can be displayed, the information displayed can be changed by the user by pushing on front glass 135, through one of the windows, to activate the dome switch associated with that window. For example, to change the information displayed in window 170, or to control some function of the aircraft in which switch array 100 is installed, the user would press glass plate 135 accessible through window 170. Pressing upon glass plate 135 exposed in window 170 causes the glass plate to pivot about pivot members 155 and 156 at the top and right hand sides (illustrated in FIG. 1) of the switch array. This in turn causes dome switch 141 at the upper right hand corner of the switch array to be actuated or activated. Activation of dome switch 141 can occur either directly from contact with glass plate 135, or from contact between glass plate 135 and spacer 150.

Dome switches 140, 141, 142 and 143 are electrically connected to control circuitry 190, and provide signals to control circuitry 190 upon activation. Control circuitry 190 uses the signals from the dome switches to effect a change in the operation of an electronic or mechanical device. Control circuitry 190 also uses the information from the activated dome switch to control drive circuitry 115 to change the information displayed by LCD assembly 105.

Switch array 100 of the present invention provides numerous advantages. For example, existing display designs and technologies can be used to provide LCD assembly 105 of switch array 100. Likewise, with the availability of compensated LCDs, large viewing angles, sunlight readability, and built-in dimming characteristics can be easily achieved in switch array 100. By pushing front plate glass 135 when a particular switch in the switch array is to be actuated, the operator is provided an immediate feedback (tactical feel) as to the activation of the command when the glass plate pivots about the pivot members. Thus, the operator need not divert his or her attention to switch array 100 in order to visually confirm the activation of the command.

The concepts utilized in switch array 100 of including a front plate dome switch assembly (i.e., the concept of utilizing the front display glass as a portion of the switch in a manner which provides a tactical feel of switch activation) can be carried over to other display technologies as well. For example, while LCD assembly 105 is preferred in some embodiments, other technologies such as field emission displays (FED), electroluminescent (EL) displays, and plasma displays can be utilized instead with the tactical feel switch concept of the present invention. Further, this concept can be used with night vision (NVG) displays.

Figure 3:
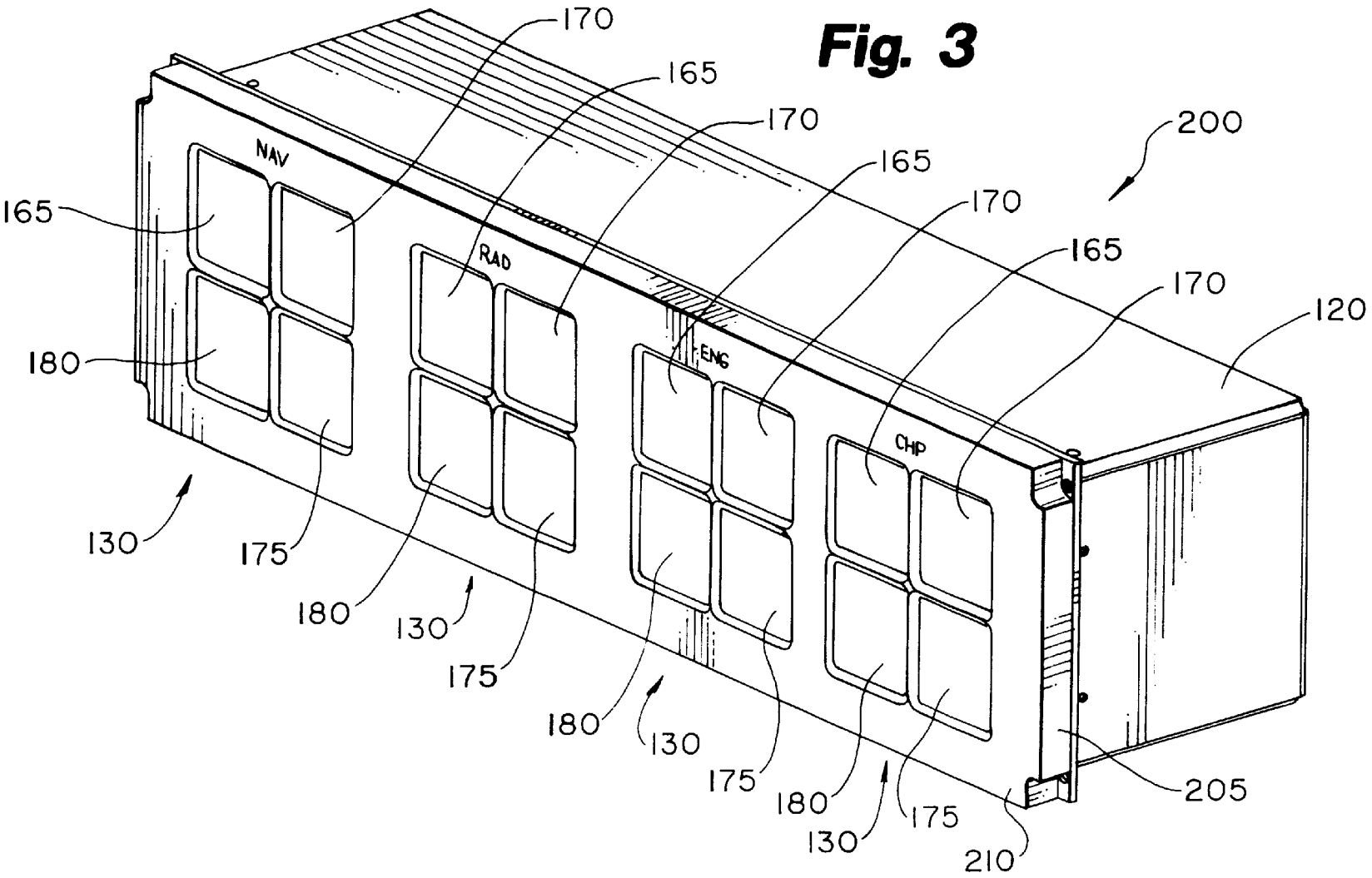
FIG. 3 is a perspective view of a 16-switch array in accordance with embodiments of the present invention.

FIG. 3 is a perspective illustration of a 16-switch array 200. Programmable switch array 200 is substantially similar to switch array 100, except that it includes four times as many switches. Thus, in switch array 200, bezel 205 includes front switch panel 210 having four sets of the four windows 165, 170, 175 and 180. The four sets of four windows function with four separate front plate dome assemblies 130 to provide sixteen switches.

Figure 4:
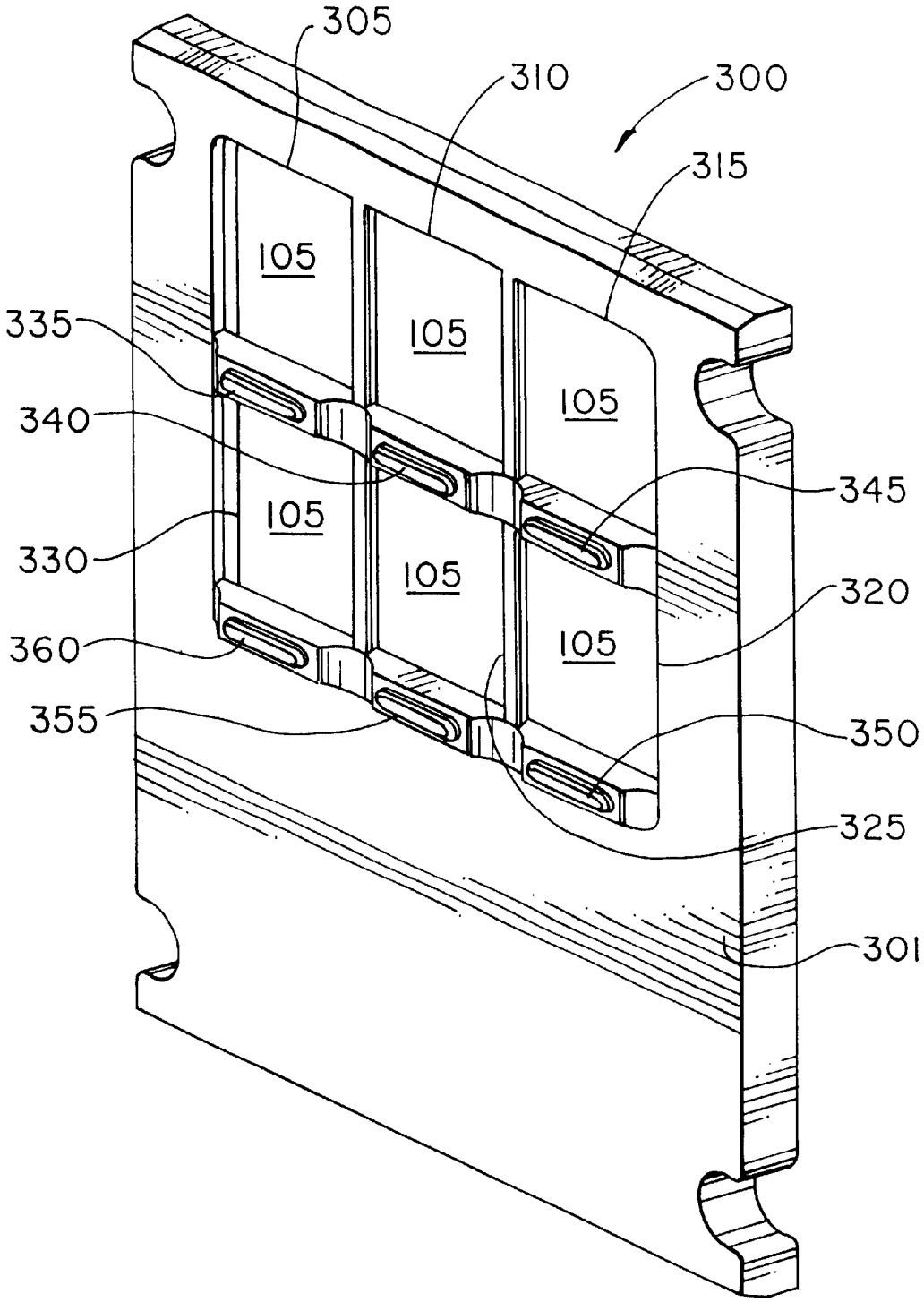
FIG. 4 is a perspective view of a. programmable switch array front panel in accordance with alternate embodiments of the present invention.

FIG. 4 is a diagrammatic perspective illustration of programmable switch array 300 in accordance with alternate embodiments of the present invention. Programmable switch array 300 includes front panel 301 having windows 305, 310, 315, 320, 325 and 330 formed therein. Through these windows, LCD assembly 105 (best illustrated in FIG. 2) can be viewed. Thus, information for six individual switches can be provided by LCD assembly 105. Also in front panel 301 are switches 335, 340, 345, 350, 355 and 360 adjacent windows 305, 310, 315, 320, 325 and 330 respectively. In embodiments of switch array 300, the switches are activated directly by contact from the operator or user, and not by the operator or user pressing upon a pivoting front plate glass. However, switches 335, 340, 345, 350, 355 and 360 are illuminated using backlight 110 (shown in FIG. 2), which also provides a source of light for LCD assembly 105. By activating one of the backlighted switches, the information displayed by LCD assembly 105 in the corresponding window is changed.

Although the present invention has teen described with reference to preferred embodiments, workers skilled in the art will recognize that changes may be made in form and detail without departing from the spirit and scope of the invention. For example, the phrase ▒ Stactical feel ▒ will be understood to represent a switch characteristic in which activation or actuation of the switch results in sufficient movement of the portion of the switch being contacted by the operator or user such that the operator is made aware of the activation without the need for visual conformation.

What is claimed is:

1. A switch array for viewing by a user, the switch array comprising:

a display device adapted to display switch information;

a glass plate positioned in front of the display device;

a plurality of switching mechanisms positioned behind the glass plate; and a pivot member positioned behind the glass plate and disposed such that upon the user pushing upon a region of the glass plate, the entire glass plate pivots about the pivot member and actuates a corresponding one of the plurality of switching mechanisms.

2. The switch array of claim 1, wherein the plurality of switching mechanisms include a plurality of dome switches.

3. The switch array of claim 1, wherein the plurality of switching mechanisms include four switching mechanisms positioned behind respective corners of the glass plate.

4. The switch array of claim 3, and further comprising a plurality of pivot members positioned behind the glass plate and disposed such that upon the user pushing upon the region of the glass plate, the glass plate pivots about at least one of the plurality of pivot members and actuates the corresponding one of the four switching mechanisms.

5. The switch array of claim 4, wherein the plurality of pivot members includes four rocker pins, with each of the four rocker pins positioned behind different respective ones of four side edges of the glass plate.

6. The switch array of claim 1, wherein the display device is a liquid crystal display device.

7. The switch array of claim 1, wherein the display device is an FED field emissions display device.

8. The switch array of claim 1, wherein the display device is an electroluminescent display device.

9. The switch array of claim 1, wherein the display device is a plasma display device.

10. A programmable switch array for use by an operator, the programmable switch array comprising:

a plurality of switching mechanisms;

a display device adapted to display switch information for the plurality of switching mechanisms;

a front panel positioned in front of the display device and dividing the display device into a plurality of display areas, wherein each of the plurality of display areas displays information for one of the plurality of switching mechanisms; and switch activation means for activating one of the plurality of switches and for providing tactical feel feedback to the operator, wherein the switch activation means comprises:

a glass plate positioned in front of the display device and the plurality of switching mechanisms and positioned behind the front panel, the glass plate being exposed in each of the plurality of display areas; and a pivot mechanism positioned behind the glass plate and disposed such that upon the operator pushing upon a region of the glass plate, the glass plate pivots about the pivot mechanism and activates a desired one of the plurality of switching mechanisms.

11. The programmable switch array of claim 10, wherein the plurality of switching mechanisms include a plurality of dome switches.

12. The programmable switch array of claim 10, wherein the plurality of switching mechanisms include four switching mechanisms positioned behind respective corners of the glass plate.

13. The programmable switch array of claim 12, and further comprising a plurality of pivot mechanisms positioned behind the glass plate and disposed such that upon the operator pushing upon the region of the glass plate, the glass plate pivots about at least one of the plurality of pivot mechanisms and activates the desired one of the four switching mechanisms.

14. The programmable switch array of claim 13, wherein the plurality of pivot mechanisms includes four rocker pins, with each of the four rocker pins positioned behind different respective ones of four side edges of the glass plate.

* * * * *